US006602178B2

(12) United States Patent
Inaniwa et al.

(10) Patent No.: US 6,602,178 B2
(45) Date of Patent: Aug. 5, 2003

(54) DESK-TOP CENTRIFUGE HAVING IMPROVED SAFETY IN THE EVENT OF AN OPERATIONAL FAILURE

(75) Inventors: Masahiro Inaniwa, Hitachinaka (JP); Masanori Yoshioka, Mito (JP); Tsutomu Takamura, Ibaraki-ken (JP); Masaharu Aizawa, Hitachinaka (JP); Kouiti Akatsu, Hitachi (JP)

(73) Assignee: Hitachi Koki Co., Ltd., Tokyo (JP)

( * ) Notice: Subject to any disclaimer, the term of this patent is extended or adjusted under 35 U.S.C. 154(b) by 18 days.

(21) Appl. No.: 09/808,180

(22) Filed: Mar. 15, 2001

(65) Prior Publication Data

US 2001/0023229 A1 Sep. 20, 2001

(30) Foreign Application Priority Data

Mar. 17, 2000 (JP) ..... 2000-076139

(51) Int. Cl.[7] ..... B04B 7/06; B04B 9/10
(52) U.S. Cl. ..... 494/7; 494/12
(58) Field of Search ..... 494/1, 7–12, 16, 494/84; 318/434, 462, 465

(56) References Cited

U.S. PATENT DOCUMENTS 3,436,637 A * 4/1969 Ehret
3,636,545 A * 1/1972 Boyd et al.
3,921,047 A * 11/1975 Carter et al.
4,105,903 A * 8/1978 Shaw et al.
4,700,117 A * 10/1987 Giebeler et al.
4,903,191 A * 2/1990 Fries
5,280,975 A * 1/1994 Tscheu et al.
5,485,066 A 1/1996 Zeigler
5,572,100 A 11/1996 Moulton
5,649,893 A * 7/1997 Inaniwa et al.
5,726,550 A 3/1998 Inaniwa et al.
5,917,688 A * 6/1999 Kido et al.
6,334,841 B1 * 1/2002 Letourneur

FOREIGN PATENT DOCUMENTS

JP 60000851 1/1985
JP 08052382 2/1996
WO 87/00770 * 2/1987

* cited by examiner

*Primary Examiner*—Charles E. Cooley
(74) *Attorney, Agent, or Firm*—McDermott, Will & Emery

(57) ABSTRACT

A desk-top centrifuge is provided which includes a switching element disposed between a dc power supply and a motor and a controlling circuit. The controlling circuit receives a voltage of power regenerated by the motor to provide a pulse width-controlled on-off signal to the drive switching element to control speed of the motor. The controlling circuit increases an on-duration in which the on-off signal is at an on-level at a given rate to turns the motor slowly. The centrifuge has a safety guard system made up of a door switch and a door lock switch which are installed in series between the dc power supply and the motor and work to establish electric communication between the dc power supply and the motor when the door is closed and locked.

5 Claims, 6 Drawing Sheets

DESK-TOP CENTRIFUGE HAVING IMPROVED SAFETY IN THE EVENT OF AN OPERATIONAL FAILURE

BACKGROUND OF THE INVENTION

1. Technical Field of the Invention

The present invention relates generally to an improvement on a small-sized desk-top centrifuge using an AC adaptor designed to output a dc constant voltage to an electric motor for rotating a rotor.

2. Background Art

Typical desk-top centrifuges designed for personal use have an encoder coupled to an output shaft of an electric motor for a rotor to measure the speed of the rotor for rotor speed control and door lock control in which a door of the centrifuge is locked during rotation of the rotor, while the lock is released when the speed of the rotor is decreased.

The installation of the encoder on the output shaft of the motor, however, results in an increase in overall height of the centrifuge, thereby causing the center of gravity of the centrifuge to be shifted upward. This will lead to instability of the rotor during rotation at high speeds.

In order to facilitate ease of operation, the desk-top centrifuges have a door switch which is turned on when the door is closed to start the rotor automatically. There is, however, a problem in that a failure of the door switch may cause the rotor to rotate unexpectedly although the door is opened.

Usually, a power supply such as an AC adaptor designed to output a constant voltage is used in the desk-top centrifuges which has a safety guard system for avoiding the overcurrent. In order to prevent a start current initiating the operation of the motor from causing the safety guard system to be actuated undesirably, a resistor may be coupled in series with the motor. The use of the resistor, however, may result in a lack of the start current required to actuate the motor, especially after the centrifuge is kept in a low-temperature condition, for example, within a refrigerator

SUMMARY OF THE INVENTION

It is therefore a principal object of the invention to avoid the disadvantages of the prior art.

It is another object of invention to provide an improved structure of a centrifuge which allows the center of gravity to be kept at a low level and which is designed to improve the safety in the event of a failure of a system operation.

According to one aspect of the invention, there is provided a centrifuge which comprises: (a) a dc power supply; (b) a motor driving a rotor; (c) a drive switching element disposed between the dc power supply and the motor; and (d) a controlling circuit receiving a voltage of power regenerated by the motor to provide a pulse width-controlled on-off signal to the drive switching element to control speed of the motor. The controlling circuit increases an on-duration in which the on-off signal is at an on-level with time.

In the preferred mode of the invention, the controlling circuit produces a first pulse-width controlled signal whose pulse width increases with time and a second pulse-width controlled signal derived by feedback control to keep the speed of the motor constant and selects one of the first and second pulse-width controlled signals whose pulse width is smaller as the pulse-width controlled on-off signal.

The centrifuge further comprises a motor decelerating switching element connected in parallel to the motor. When it is required to stop the motor, the controlling circuit provides an on-signal to the motor decelerating switching element for a given period of time to decrease the speed of the motor, after which the controlling circuit provides a pulse width-controlled signal to the motor decelerating switching element to turn on and off the motor decelerating switching element cyclically until the voltage of power regenerated by the motor decreases to a given level.

The centrifuge further comprises a door, a movable door hook designed to lock and unlock the door selectively, a spring bringing the door hook into a door-locked state to lock the door, and a solenoid energized by the controlling circuit to attract the door hook against an elastic pressure of the spring to bring the door hook into a door-unlocked state to unlock the door. The controlling circuit provides the on-signal to the motor decelerating switching element for the given period of time to decrease the speed of the motor and provides the pulse width-controlled signal to the motor decelerating switching element to turn on and off the motor decelerating switching element cyclically until the voltage of power regenerated by the motor decreases to the given level, after which the controlling circuit energizes the solenoid.

The centrifuge further comprises an interlock spring which holds the door hook being in the door-unlocked state and releases holding of the door hook when the door is closed, a door lock switch disposed between the dc power supply and the motor, a door switch disposed between the dc power supply and the motor in series with the door lock switch. The controlling circuit controls the door lock switch and the door switch to establish electric communication between the dc power supply and the motor after the door is closed, and the door hook is placed in the door-locked state.

BRIEF DESCRIPTION OF THE DRAWINGS

The present invention will be understood more fully from the detailed description given hereinbelow and from the accompanying drawings of the preferred embodiments of the invention, which, however, should not be taken to limit the invention to the specific embodiments but are for the purpose of explanation and understanding only.

In the drawings.

DESCRIPTION OF THE PREFERRED EMBODIMENTS

Figure 1:
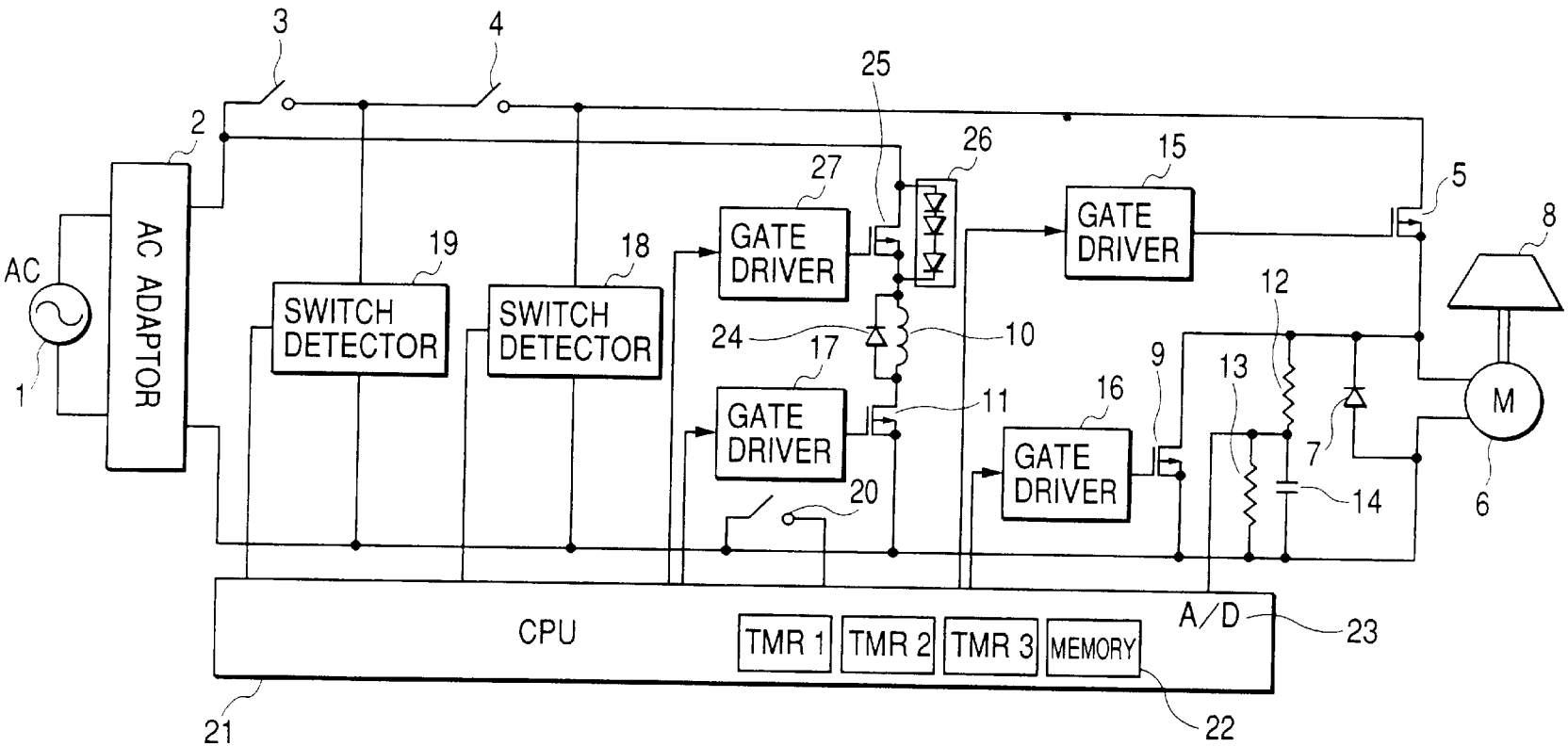
FIG. 1 is a circuit diagram which shows a desk-top centrifuge according to the present invention.

Referring to the drawings, wherein like reference numbers refer to like parts in several views, particularly to FIG. 1, there is shown a desk-top centrifuge according to the invention which is designed to rotate a rotor at a constant speed and suitable for separating a mixture of components in a short time.

The centrifuge generally includes an AC power supply 1, an AC adaptor 2, a door switch 3, a door lock detector 4, a drive switching element 5 such as a transistor, an FET or an IGBT, an electric motor 6 made up of dc magnet motors coupled in series, and a rotor 8 The AC adaptor 2 is supplied with ac power from the AC power supply and outputs dc power. The rotor 8 is rotated by the motor 6 to separate a mixture of components put in the rotor 8. As the mixture to be separated in the centrifuge of this embodiment, substances easy to separate in a short time are preferable.

The centrifuge also includes a circulating diode 7, a switching element 9 such as a transistor, an FET, or an IGBT, a solenoid 10, a switching element 11 for energizing the solenoid 10, a voltage-selecting switching element 25, a voltage-drop element 26, and a circulating diode 24. The circulating diode 7 is coupled in parallel to the motor 6. The switching element 9 works to decelerate the motor 6. The solenoid 10 is connected to outputs of the AC adaptor 2 and works to release a lock of a door, as will be described later in detail, of the centrifuge. Specifically, when the switching element 11 is turned on, the current is supplied to energize the solenoid 10, thereby releasing the lock of the door. The voltage-selecting switching element 25 works to select one of voltages to be supplied to the solenoid 10. The voltage-drop element 26 made of diodes or Zener diodes is coupled in parallel to the voltage-selecting switching element 25 The circulating diode 24 is connected in parallel to the solenoid 10.

The centrifuge also includes a controlling circuit 21 made of a single chip CPU, resistors 12 and 13, a capacitor 14, and gate drivers 15, 16, 17, and 27. The resistors 12 and 13 are coupled in parallel to the motor 6 and work as a potential divider which produces a fraction of the voltage of power regenerated by the motor 6 (i.e., the electromotive force). The capacitor 14 removes the ripple from the fraction, which is, in turn, inputted to an A/D converting input terminal 23 of the controlling circuit 21. The gate driver 15 is responsive to a signal from the controlling circuit 21 to control an on-off operation of the drive switching element 5. The gate driver 16 controls an on-of operation of the deceleration switching element 9. The gate driver 17 controls an on-off operation of the switching element 11. The gate driver 27 controls an on-off operation of the switching element 25.

The centrifuge also includes switch detectors 18 and 19 and a stop switch 20. The switch detector 18 detects an operating condition (i.e., an on- or off-state) of the door lock detector 4 and provides a signal indicative thereof to the controlling circuit 21. Similarly, the switch detector 19 detects an operating condition (i.e., an on- or off-state) of the door switch 3 and provides a signal indicative thereof to the controlling circuit 21. The stop switch 20 is connected to an input terminal of the controlling circuit 21.

Figure 2:
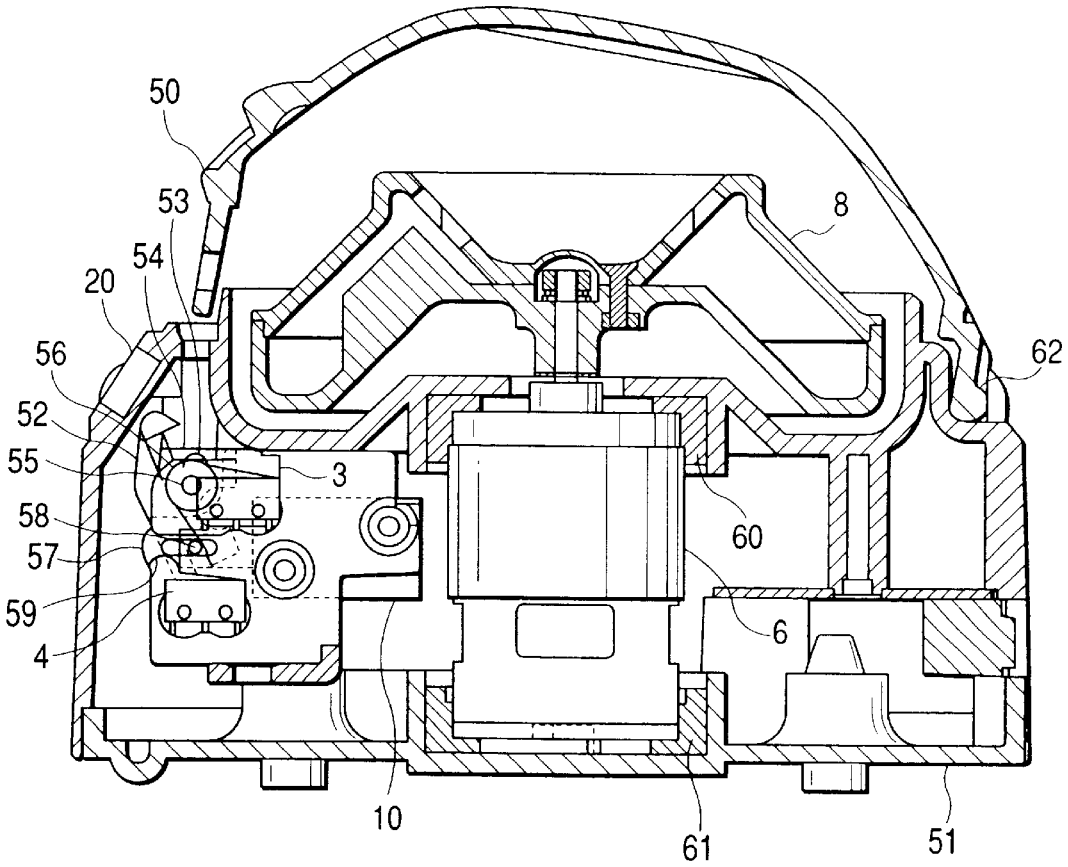
FIG. 2 is a vertical sectional view which shows a desk-top centrifuge when a door is opened.
Figure 3:
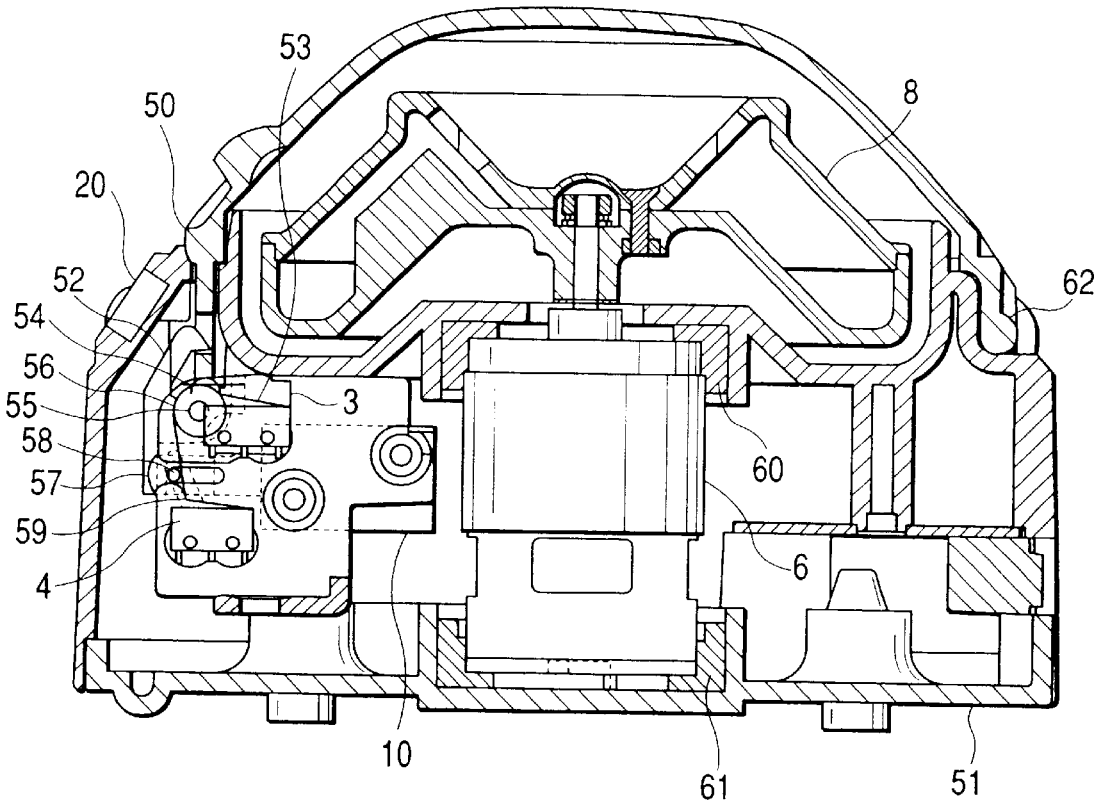
FIG. 3 is a vertical sectional view which shows a desk-top centrifuge when a door is closed.

The centrifuge also includes, as shown in FIGS. 2 and 3, a body 51. The body 51 has a door 50 which is opened manually when a mixture is put in or taken out of the rotor 8. A door hook 52 is movably retained by a support pin 55 and urged by a helical spring 56, as shown in FIG. 3, to lock the door 50 at all times. A movable pin 58 is installed on a plunger 57 magnetically linked to the solenoid 10 and fitted in the door hook 52. When energized, the solenoid 10 attracts the plunger 57 and moves the door hook 52, as shown in FIG. 2, against the spring pressure of the helical spring 56 to unlock the door 50. The door 50 is connected pivotably through a hinge mechanism 62 to a portion of the body 51 opposed diametrically to the door hook 52. The helical spring 56, as described above, elastically urges the movable pin 58 to keep the door 52 locked through the door hook 52 and pushes a lever 59 through the movable pin 58 to keep the door lock detector 4 turned on. An interlock spring 54 engages and locks the door hook 52, as shown in FIG. 2, when brought into an unlocked state. When the door 50 is closed, as shown in FIG. 3, the interlock spring 54 is pressed by an end of the door 50 and deformed elastically to be fitted in a recess or curved portion of the door hook 52, thereby releasing the lock of the door hook 52. When the door 50 is closed, the door 50 pushes a lever 53 to turn on the door switch 3. An upper damper 60 and a lower damper 61 are disposed on an upper and a lower end of the motor 6 to minimize the transmission of vibration from the motor 6 to the body 51. The stop switch 20 is installed in a front wall of the body 51.

Figure 4:
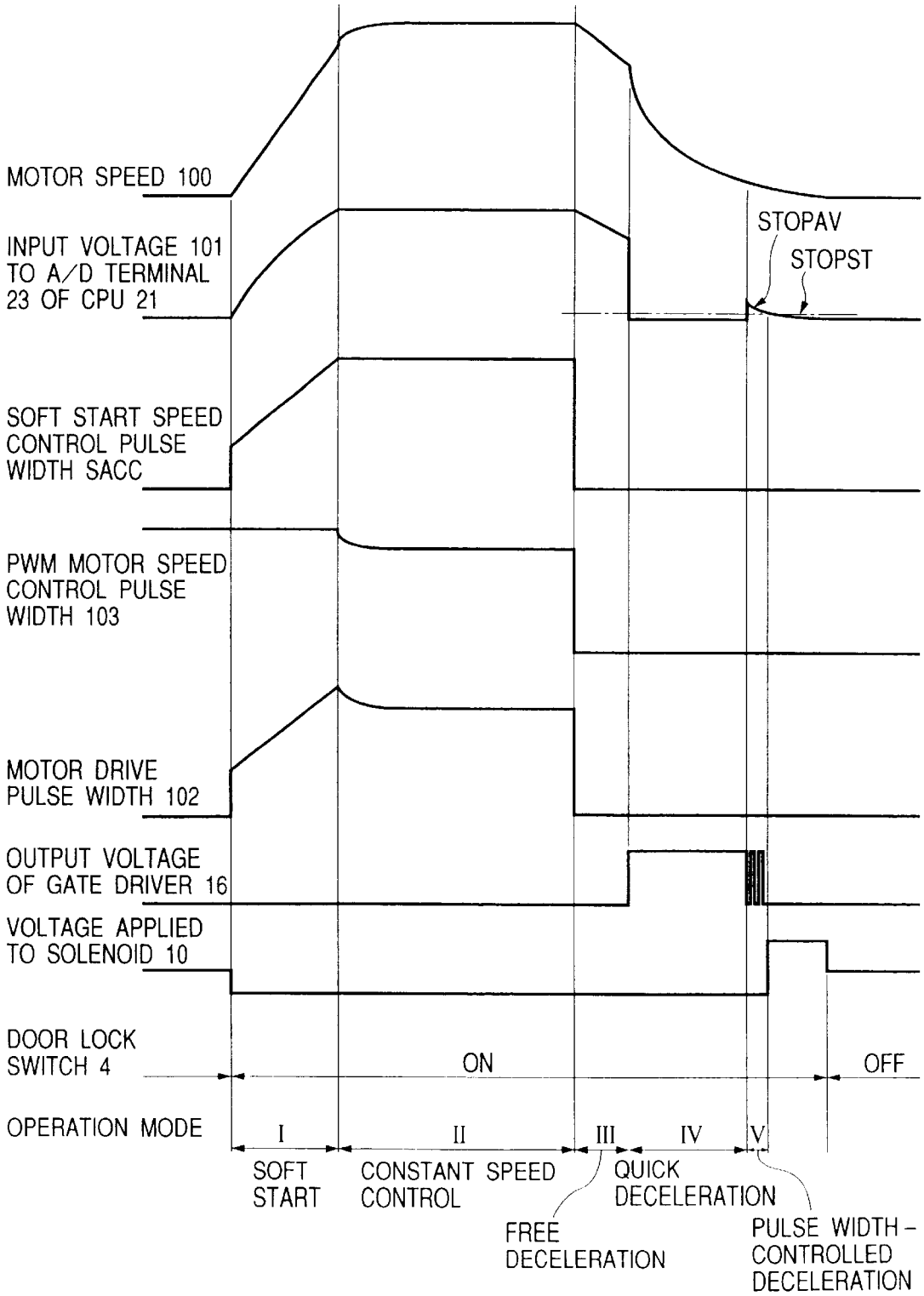
FIG. 4 is a time chart which shows operation modes of motor speed control.

FIG. 4 is a time chart which shows a sequence of operations of the centrifuge.

In an operation mode I, the CPU 21 accelerates the motor 6 slowly (referred to as a soft start below). Specifically, when the door 50 is closed, the interlock spring 54 is elastically deformed and fitted in the curved portion of the door hook 52 to release the lock of the door hook 52. Simultaneously, the door switch 3 is turned on, so that the switch detector 19 outputs an ON-signal of high level Hi. The controlling circuit 21 is responsive to the ON-signal from the switch detector 19 and provides an off-signal to the gate driver 17 to turn off the switching element 11. When the switching element 11 is turned off, the solenoid 10 is deenergized. This causes the door hook 52 to be urged by the helical spring 56 into constant engagement with the door 50, so that the door 50 is locked. Simultaneously, the movable pin 58 pushes the lever 59 to turn on the door lock detector 4, thereby allowing the motor 6 to be activated.

Therefore, if the door switch 3 has failed so that it is turned on undesirably to deenergize the solenoid 10 even though the door 50 is opened, the interlock spring 54 continues locking the door hook 52, so that the movable pin 58 is kept in the unlocked state without pushing the lever 59. The door lock detector 4 is, thus, kept off, so that the voltage is not applied to the motor 6. Alternatively, if the door lock detector 4 has failed so that it is turned on undesirably even though the door 50 is kept opened, the voltage is not applied to the motor 6 until the door 50 is closed, and the door switch 3 is turned on. Specifically, the motor 6 is kept off until the door 50 is closed completely, thus avoiding an accidental touch of a human operator to the rotor 8 during rotation of the motor 6.

When the door 50 is closed completely, the controlling circuit 21 outputs an ON-signal to the gate driver 15 to turn on the switching element 5 for initiating rotation of the motor 6 and, at the same time, sets a count of 10 minutes in an internal timer TMR2 for avoiding the dry up of a mixture of components to be separated, as described later in detail. The motor 6 is a dc motor. If, therefore, 100% of an output voltage of the dc power supply is applied instantaneously to the motor 6, it will cause an excessive starting current produced as a function of a resistance value of a coil of the motor 6 to flow out of the dc power supply 2, so that an overload protection (also called an overcurrent protection) installed in the dc power supply 2 is activated to decrease the output voltage, thus disenabling the motor 6. In order to avoid this problem, the controlling circuit 21 executes a soft start control operation in which a pulse width or on-duration of an on-off signal to be outputted to the gate driver 15 is increased gradually under the so-called PWM control. The soft start operation will be described below in detail with reference to FIG. 5.

Figure 5:
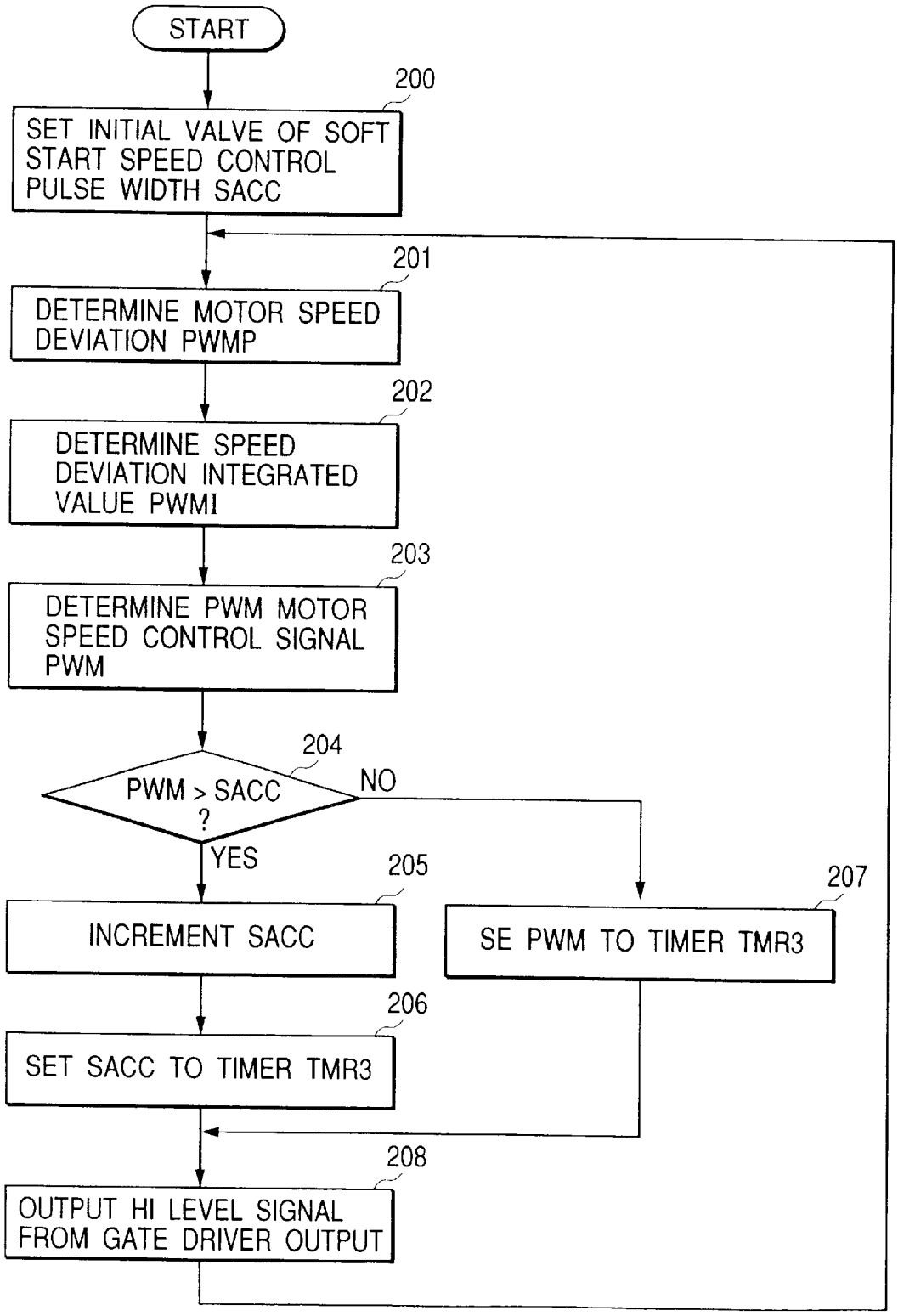
FIG. 5 is a flowchart of a program performed to control a soft start motor speed operation and a constant motor speed control operation.
Figure 6:
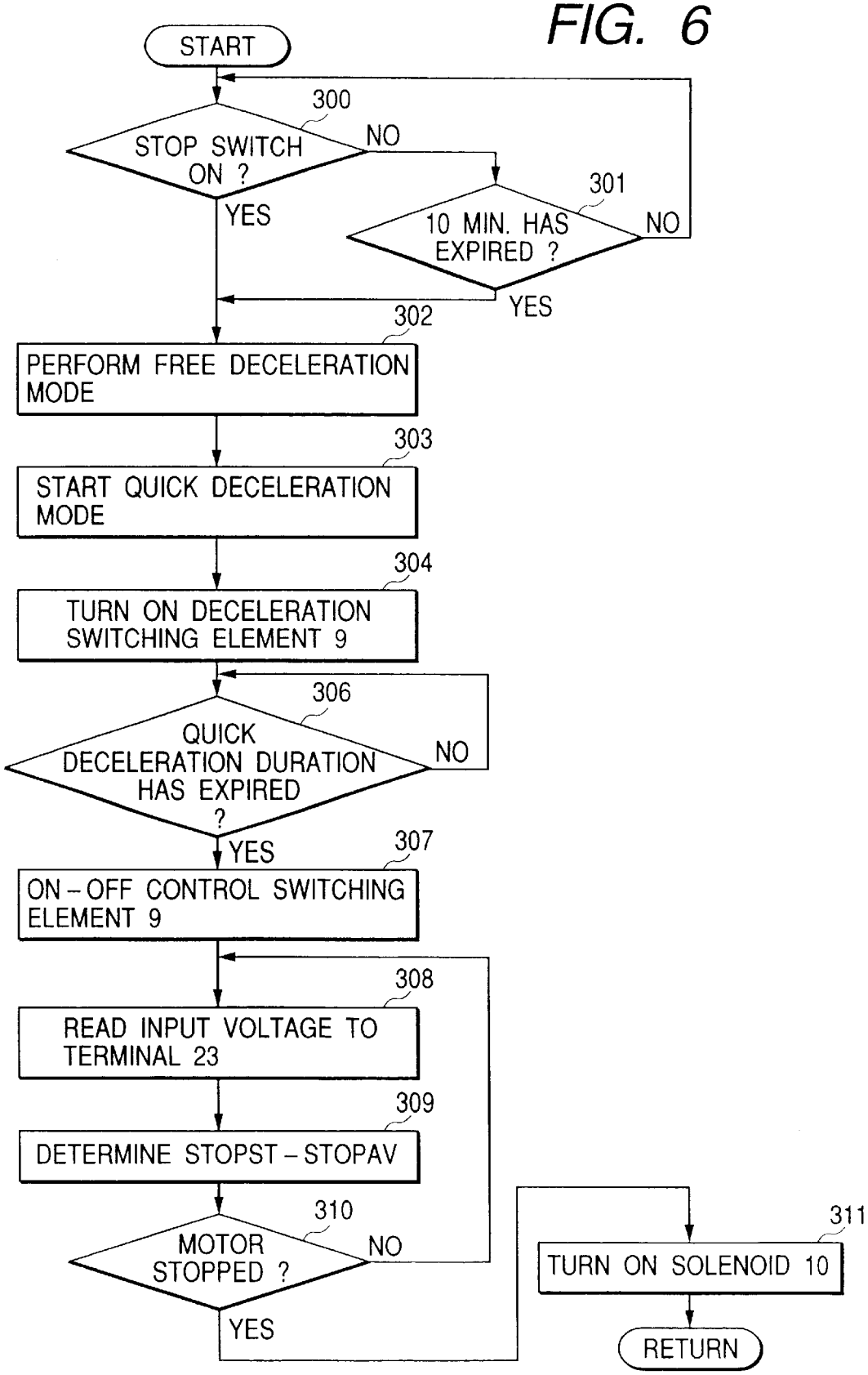
FIG. 6 is a flowchart of a program performed to control a free deceleration operation and a quick deceleration operation.

The controlling circuit 21 performs a program, as shown in FIG. 5, at a given time interval by timer interruption.

After entering the program, the routine proceeds to step 200 wherein an initial value of a soft start speed control pulse width SACC is set in a given location of the memory 22 for producing a maximum starting torque in the motor 6.

The routine proceeds to step 201 wherein the power voltage 101 (see FIG. 4) inputted to the A/D converting input terminal 23 of the controlling circuit 21 is defined as an actual speed of the motor 6, and a difference between a target speed and the actual speed of the motor 6 is determined as a motor speed deviation PWMP.

The routine proceeds to step 202 wherein a speed deviation integrated value PWMI is determined by the sum of PWMI derived one program cycle earlier and a parameter S. The parameter S may be selected from five different values predetermined linearly or nonlinearly as a function of the motor speed deviation PWMP and has a sign identical with that of the motor speed deviation PWMP.

The routine proceeds to step 203 wherein a PWM motor speed control pulse width 103, as indicated in FIG. 4, is determined by the sum of the motor speed deviation PWMP and the speed deviation integrated value PWMI derived in step 202.

The routine proceeds to step 204 wherein it is determined whether the PWM motor speed control pulse width 103 is greater than the soft start speed control pulse width SACC stored in the memory 22 or not.

If a YES answer is obtained in step 204, then the routine proceeds to step 205 wherein the soft start speed control pulse width SACC is incremented by one (1) and stored in the memory 22. The CPU 21 continues to perform the soft start operation.

The routine proceeds to step 206 wherein a count value equivalent to the soft start speed control pulse width SACC is set in a timer TMR3 installed in the CPU 21.

The routine proceeds to step 208 wherein the CPU 21 turns on the drive switching element 5 through the gate driver 15 for a period of time equivalent to the count value of the timer TMR3. Specifically, the CPU 21 provides the on-off signal (i.e., a motor drive signal) whose pulse width 102, as shown in FIG. 4, is defined by the soft start speed control pulse width SACC to the gate driver 11 and actuates the motor 6 in the soft start mode.

Steps 201 to 208 are executed cyclically until a condition of PWM≦SACC is met in step 204. The pulse width 102 of the motor drive signal increases with an increase in the soft start speed control pulse width SACC in step 205, so that the speed 100 of the motor 6, as shown in FIG. 4, increases, and the voltage of power regenerated by the motor 6 inputted to the A/D converting input terminal 23 rises. Therefore, in the soft start operation (i.e., the operation mode I in FIG. 4), the CPU 21 controls the motor 6 to produce a maximum torque while keeping the motor start current below an overcurrent protective level of the dc power supply 2.

If a NO answer is obtained in step 204 (i.e., PWM≦SACC), then the routine proceeds to step 207 wherein the CPU 21 enters a constant speed control mode (i.e., an operation mode II shown in FIG. 4), to select the PWM motor speed control pulse width 103 as the motor drive pulse width 102 and runs the motor 6 at a target speed. Specifically, in step 207, a count value equivalent to the PWM motor speed control pulse width 103 is set in the timer TMR3. Subsequently, the routine proceeds to step 208 wherein the CPU 21 turns on the drive switching element 5 through the gate driver 15 for a period of time equivalent to the count value of the timer TMR3. Specifically, the CPU 21 provides the motor drive signal whose pulse width 102, as shown in FIG. 4, is defined by the PWM motor speed control pulse width 103 to the gate driver 15 and keeps the speed 100 of the motor 6 constant.

In the constant speed control mode II, the CPU 21 controls the speed of the motor 6 based on motor-regenerated power voltage characteristics in which the voltage of power regenerated by the motor 6 varies substantially in proportion to the speed of the motor 6, thus eliminating the need for a speed sensor such as an encoder. Additionally, even if the dc power supply 2 has failed, resulting in application of an excessive voltage to the motor 6, the constant speed control mode II works to avoid undesirable high speed rotation of the motor 6.

When it is required to brake the motor 6, the CPU 21 performs a program, as shown in FIG. 5, and enters a free deceleration mode (i.e., an operation mode III in FIG. 4) and a quick deceleration mode (i.e., an operation mode IV in FIG. 4) in sequence.

After entering the program in FIG. 5, the routine proceeds to step 300 wherein it is determined whether the stop switch 20 is depressed or not. If a YES answer is obtained, then the routine proceeds to step 302. Alternatively, if a NO answer is obtained, then the routine proceeds to step 301 wherein it is determined whether a count of 10 minutes set in the timer TMR2 for avoiding the dry up of a mixture of components to be separated has been elapsed or not. If a NO answer is obtained, then the routine returns back to step 300. Alternatively, if a YES answer is obtained, then the routine proceeds to step 302. Note that the count of 10 minutes set in the timer TMR2 is determined in view of the safety of the centrifuge and the time required to separate a mixture, and another count, for example, 15 or 20 minutes may be set in the timer TMR2 depending upon the type of a mixture to be separated in the centrifuge.

In step 302, the CPU 21 enters the free deceleration mode III to decelerate the motor 6 naturally. The free deceleration mode III is provided for avoiding an undesirable change in mounted position of the motor 6 which will arise when the constant speed control mode II is switched directly to the quick deceleration mode IV, and a reactive force produced by a sudden drop in motor speed applies the torque to the upper damper 60 and the lower damper 61 to change the position of the motor 6. The CPU 21 turns off the gate driver 15 to keep the fee deceleration mode III for approximately 0.5 sec.

Subsequently, the routine proceeds to step 303 in which the CPU 21 enters the quick deceleration mode IV. The CPU 21 determines a quick deceleration duration proportional to the voltage inputted to the A/D converting input terminal 23, that is, the speed of the motor 6 and sets the quick deceleration duration in the internal timer TMR1.

The routine proceeds to step 304 wherein the CPU 21 turns on the switching element 9 through the gate driver 16.

The routine proceeds to step 306 wherein it is determined whether the quick deceleration duration set in the timer TMR2 has expired or not. If a NO answer is obtained, then the routine repeats step 306. Alternatively, if a YES answer is obtained, then the routine proceeds to step 307 wherein a pulse width-controlled deceleration mode (i.e., an operation mode V in FIG. 4) is entered.

In the pulse width-controlled deceleration mode V, the CPU 21 outputs an on-off signal having a duty cycle of, for example, 50% to the switching element 9 through the gate driver 16.

The routine proceeds to step 308 wherein the CPU 21 reads out the voltage inputted to the A/D converting input terminal 23 which arises from a regenerated electromotive force stepped up by an internal inductance of the motor 6 and defines it as a voltage STOPAV, as shown in FIG. 4. The voltage STOPAV is used in a following step as a decision parameter to determine whether the motor 6 has stopped or not because a voltage regenerated by the motor 6 when the speed of the motor 6 is almost zero (0) is too small to be used in determining whether the speed of the motor 6 has been reduced to zero (0) or not.

The routine proceeds to step 309 wherein the stepped up voltage STOPAV is subtracted from a motor stopping reference voltage STOPST for determining whether the pulse width-controlled deceleration mode should be terminated or not in a following step.

The routine proceeds to step 310 wherein it is determined whether a difference between STOPST and STOPAV is smaller than or equal to zero (0) or not. If a NO answer is obtained (STOPST−STOPAV≦0) meaning that the motor 6 is still rotating, the routine returns back to step 308. Alternatively, if a YES answer is obtained meaning that the speed of the motor 6 has been reduced substantially to zero (0), then the routine proceeds to step 311 wherein the CPU 21 turns off the switching element 9 through the gate driver 16 to terminate the pulse width-controlled deceleration mode V. When a motor speed of 389 $min^{-1}$ at which the peripheral speed of the rotor 8 is decreased below 2 m/sec. is detected, the CPU 21 releases the door lock. Specifically, the CPU 21 turns on the switching element 11 through the gate driver 17 to energize the solenoid 10, thereby attracting the plunger 57 and moving the door hook 52 against the spring pressure of the helical spring 56 to unlock the door 50.

The CPU 21 continues to energize the solenoid 10 to provide a higher degree of attracting force to the plunger 57 until the door lock detector 4 is turned off after which the CPU 21 turns off the switching element 25 through the gate driver 27 to apply the voltage of the dc power supply 2 stepped down by the voltage-drop element 26 to the solenoid 10, thereby avoiding an undesirable rise in temperature of the solenoid 10.

While the present invention has been disclosed in terms of the preferred embodiments in order to facilitate better understanding thereof, it should be appreciated that the invention can be embodied in various ways without departing from the principle of the invention. Therefore, the invention should be understood to include all possible embodiments and modifications to the shown embodiments witch can be embodied without departing from the principle of the invention as set forth in the appended claims.

What is claimed is:

1. A centrifuge comprising:

a dc power supply;

a motor driving a rotor;

a drive switching element disposed between said dc power supply and said motor; and a control means for receiving a voltage of power regenerated by said motor and outputting a pulse width-controlled on-off signal to said drive switching element to control speed of said motor, said control means outputting the pulse width-controlled on-off signal by producing a first pulse width-controlled signal whose pulse width increases with time and a second pulse width-controlled signal to keep the speed of said motor constant and selecting one of the first and second pulse width-controlled signals whose pulse width is smaller as the pulse width-controlled on-off signal.

2. The centrifuge as set forth in claim 1, wherein said control means produces the second pulse-width controlled signal through feedback control using the voltage of power regenerated by said motor.

3. A centrifuge comprising:

a dc power supply;

a motor driving a rotor;

a motor decelerating switching element connected in parallel to said motor; and a control means for receiving a voltage of power regenerated by said motor and outputting a pulse width-controlled on-off signal, when it is required to stop said motor, said control means providing an on-signal to said motor decelerating switching element for a given period of time to decrease the speed of said motor, after which said control means provides a pulse width-controlled on-off signal to said motor decelerating switching element to turn on and off said motor decelerating switching element cyclically until the voltage of power regenerated by said motor decreases to a given level.

4. The centrifuge as set forth in claim 3, further comprising:

a door;

a movable door hook designed to lock and unlock the door selectively;

a spring bringing the door hook into a door-locked state to lock said door; and a solenoid energized by said control means to attract said door hood against an elastic pressure of said spring to bring said door hook into a door-unlocked state to unlock the door, wherein said control means provides the on-signal to said motor decelerating switching element for the given period of time to decrease the speed of said motor and provides the pulse width-controlled on-off signal to said motor decelerating switching element to turn on and off said motor decelerating switching element cyclically until the voltage of power regenerated by said motor decreases to the given level, after which said control means energizes the solenoid.

5. The centrifuge as set forth in claim 4, further comprising:

an interlock spring which holds said door hook being in the door-unlocked sate and releases holding of said door hook when said door is closed;

a door lock switch disposed between said dc power supply and said motor; and a door switch disposed between said dc power supply and said motor in series with said door lock switch, wherein said control means controls said door lock switch and said door switch to establish electric communication between said dc power supply and said motor after said door is closed, and said door hook is placed in the door-locked state.

* * * * *